US007950597B2

(12) United States Patent
Vanblaere et al.

(10) Patent No.: US 7,950,597 B2
(45) Date of Patent: May 31, 2011

(54) ACTUATOR FOR A RECEPTACLE HAVING A PRESSURIZED CONTENT AND METHOD FOR SPRAYING A PRESSURIZED CONTENT

(75) Inventors: Roland Frans Cyrille Cornelius Vanblaere, Houthalen-Helchteren (BE); Willy Leonard Alice Kegels, Sint-Gillis-Waas (BE)

(73) Assignee: Packaging Technology Participation SA, Luxembourg (LU)

( * ) Notice: Subject to any disclaimer, the term of this patent is extended or adjusted under 35 U.S.C. 154(b) by 77 days.

(21) Appl. No.: 12/282,823

(22) PCT Filed: Mar. 13, 2007

(86) PCT No.: PCT/BE2007/000024

§ 371 (c)(1),
(2), (4) Date: Sep. 12, 2008

(87) PCT Pub. No.: WO2007/104113

PCT Pub. Date: Sep. 20, 2007

(65) Prior Publication Data

US 2009/0084872 A1 Apr. 2, 2009

(30) Foreign Application Priority Data

Mar. 14, 2006 (EP) ..... 06075598
Oct. 3, 2006 (EP) ..... 06076815

(51) Int. Cl.
*B05B 7/32* (2006.01)

(52) U.S. Cl. ..... 239/337; 239/67

(58) Field of Classification Search ..... 239/337, 239/302, 323, 328, 334, 349, 569–571, 576, 239/67–69; 137/240, 607

See application file for complete search history.

(56) References Cited

U.S. PATENT DOCUMENTS 3,053,461 A * 9/1962 Inglis ..... 239/411

(Continued)

FOREIGN PATENT DOCUMENTS

EP 0826608 A 3/1998

(Continued)

OTHER PUBLICATIONS

U.S. Appl. No. 11/685,508, filed Mar. 13, 2007 in the name of Vanblaere et al, Non-final Office Action mailed Jul. 31, 2009.

(Continued)

*Primary Examiner* — Davis Hwu

(74) *Attorney, Agent, or Firm* — Levine Bagade Han LLP

(57) ABSTRACT

The invention relates to an actuator (1) for a dispenser device for spraying contents of a receptacle that is pressurized or of a receptacle that has a pump, the actuator (1) comprising a channel connectable to a receptacle outlet (19) on one side of the actuator (1) for receiving the pressurized contents of the receptacle, said channel having an orifice (11) for spraying the contents on another side of the actuator (1), wherein the channel comprises a volume chamber, said orifice forming an outlet of the volume chamber (71), wherein the orifice (11) has a valve for opening and closing the orifice (11), the valve biased by at least biasing means in the closed position, and further comprising actuation means arranged to allow a flow of content from the receptacle into the channel and volume chamber (71). The invention is characterized in that the actuation means is coupled with the biasing means for attenuating the bias on the valve biasing the valve in the closed position, if the actuation means is actuated.

28 Claims, 6 Drawing Sheets

U.S. PATENT DOCUMENTS

| | | | |
|---|---|---|---|
| 4,182,496 | A | 1/1980 | Burke |
| 4,650,094 | A | 3/1987 | Werding |
| 5,127,579 | A | 7/1992 | Tempelman |
| 5,158,215 | A | 10/1992 | Comment et al. |
| 5,273,191 | A | 12/1993 | Meshberg |
| 5,558,258 | A | 9/1996 | Albini et al. |
| 5,624,055 | A | 4/1997 | Clanet et al. |
| 5,842,616 | A | 12/1998 | Ruscitti et al. |
| 6,026,850 | A | 2/2000 | Newton et al. |
| 6,145,712 | A | 11/2000 | Benoist et al. |
| 6,851,575 | B2 | 2/2005 | van't Hoff |
| 2002/0179634 | A1 | 12/2002 | van't Hoff |
| 2006/0278278 | A1 | 12/2006 | van't Hoff |
| 2008/0017666 | A1 | 1/2008 | Vanblaere et al. |
| 2009/0266845 | A1 | 10/2009 | Duquet |

FOREIGN PATENT DOCUMENTS

| | | |
|---|---|---|
| EP | 1200322 B1 | 5/2006 |
| EP | 1949971 | 7/2008 |
| WO | WO 03/037748 | 5/2003 |
| WO | WO 2006/024891 | 3/2006 |
| WO | WO 2009/136115 | 11/2009 |

OTHER PUBLICATIONS

U.S. Appl. No. 11/685,508, filed Mar. 13, 2007 in the name of Vanblaere et al., Final Office Action mailed Mar. 9, 2010.

European Patent Application No. 06075598 filed Mar. 14, 2006 in the name of Packaging Technology Participation SA, Office Action mailed Feb. 6, 2009.

European Patent Application No. 06075598 filed Mar. 14, 2006 in the name of Packaging Technology Participation SA, Office Action mailed Apr. 9, 2008.

European Patent Application No. 06075598 filed Mar. 14, 2006 in the name of Packaging Technology Participation SA, European Search Report mailed Jul. 11, 2006.

European Patent Application No. 06076815.7 filed Oct. 3, 2006 in the name of Packaging Technology Participation SA, Office Action mailed Feb. 6, 2009.

European Patent Application No. 06076815.7 filed Oct. 3, 2006 in the name of Packaging Technology Participation SA, European Search Report mailed Dec. 18, 2006.

European Patent Application No. 06076815.7 filed Oct. 3, 2006 in the name of Packaging Technology Participation SA, Office Action mailed Apr. 9, 2008.

European Patent Application No. 07075184.7 filed Mar. 12, 2007 in the name of Packaging Technology Participation SA, Office Action mailed Sep. 10, 2010.

European Patent Application No. 07075184.7 filed Mar. 12, 2007 in the name of Packaging Technology Participation SA, Office Action mailed Feb. 6, 2009.

European Patent Application No. 07075184.7 filed Mar. 12, 2007 in the name of Packaging Technology Participation SA, Office Action mailed Apr. 9, 2008.

European Patent Application No. 07075184.7 filed Mar. 12, 2007 in the name of Packaging Technology Participation SA, European Search Report mailed May 24, 2007.

International Patent Application No. PCT/BE2007/000024 filed Mar. 13, 2007 in the name of Packaging Technology Participation SA, Written Opinion of the International Search Authority mailed Sep. 14, 2008.

Australian Patent Application No. 2007225030 filed Mar. 13, 2007 in the name of Packaging Technology Participation SA, Office Action mailed Oct. 28, 2010.

Chinese Patent Application No. 200780009204 filed Mar. 13, 2007 in the name of Packaging Technology Participation SA, Office Action mailed Dec. 6, 2010.

Eurasian Patent Application No. 200870353 filed Mar. 13, 2007 in the name of Packaging Technology Participation SA, Office Action mailed Oct. 28, 2009.

Eurasian Patent Application No. 200870353 filed Mar. 13, 2007 in the name of Packaging Technology Participation SA, Office Action mailed Jul. 26, 2010.

New Zealand Patent Application No. 571317 filed Mar. 13, 2007 in the name of Packaging Technology Participation SA, Office Action mailed Feb. 22, 2010.

* cited by examiner

| x = 1 mm | | | x = 0,75 mm | | | x = 0,85 mm | |
|---|---|---|---|---|---|---|---|
| ml | g/sec | | ml | g/sec | | ml | g/sec |
| 1029,45 | | | 1020,38 | | | 1008,87 | |
| 1022,61 | 6,84 | | 1010,36 | 10,02 | | 1000,3 | 8,57 |
| 1015,84 | 6,77 | | 1000,56 | 9,8 | | 991,77 | 8,53 |
| 1008,89 | 6,95 | | 991,03 | 9,53 | | 983,58 | 8,19 |
| 1002,03 | 6,86 | | 981,5 | 9,53 | | 975,45 | 8,13 |
| 995,12 | 6,91 | | 972 | 9,5 | | 966,95 | 8,5 |
| 988,17 | 6,95 | | 962,5 | 9,5 | | 958,84 | 8,11 |
| 981,25 | 6,92 | | 953 | 9,5 | | 950,84 | 8 |
| 974,24 | 7,01 | | 943,8 | 9,2 | | 942,93 | 7,91 |
| 967,28 | 6,96 | | 934,4 | 9,4 | | 934,95 | 7,98 |
| 960,21 | 7,07 | | 925,09 | 9,31 | | 926,92 | 8,03 |
| 953,16 | 7,05 | | 915,83 | 9,26 | (5,5 bar) | 918,88 | 8,04 |
| 946,23 | 6,93 | | 906,98 | 8,85 | | 910,88 | 8 |
| 939,23 | 7 | | | | | 902,9 | 7,98 |
| 932,23 | 7 | | | | | | (5,5 bar) |
| 925,45 | 6,78 | (5,5 bar) | | | | | |
| 918,86 | 6,59 | | | | | | |
| 912,31 | 6,55 | | | | | | |
| 905,89 | 6,42 | | | | | | |

FIG. 5A

| spring 1 | | | spring 2 | | |
|---|---|---|---|---|---|
| ml | g/sec | bar | ml | g/sec | bar |
| 212,56 | | | 192,99 | | |
| 206,67 | 5,89 | | 185,77 | 7,22 | |
| 200,8 | 5,87 | | 178,41 | 7,36 | |
| 194,6 | 6,2 | | 170,83 | 7,58 | |
| 187,94 | 6,66 | | 163,03 | 7,8 | |
| 181,21 | 6,73 | | 155,32 | 7,71 | |
| 174,4 | 6,81 | | 147,45 | 7,87 | |
| 167,6 | 6,8 | | 139,46 | 7,99 | |
| 160,65 | 6,95 | | 131,46 | 8 | |
| 153,71 | 6,94 | | 123,5 | 7,96 | |
| 146,74 | 6,97 | | 115,63 | 7,87 | |
| 139,7 | 7,04 | | 107,66 | 7,97 | |
| 132,7 | 7 | | 99,85 | 7,81 | |
| 125,76 | 6,94 | | 92,15 | 7,7 | |
| 118,74 | 7,02 | | 84,5 | 7,65 | |
| 111,84 | 6,9 | | 76,76 | 7,74 | 5 |
| 104,84 | 7 | | 75,22 | | |
| 97,96 | 6,88 | | 67,6 | 7,62 | |
| 91,14 | 6,82 | | 60,34 | 7,26 | |
| 89,3 | | 4,5 | | | |
| 82,55 | 6,75 | | | | |
| 81,9 | | | | | |
| 75,16 | 6,74 | | | | |
| 68,44 | 6,72 | | | | |
| 62 | 6,44 | | | | |

FIG. 5B

ACTUATOR FOR A RECEPTACLE HAVING A PRESSURIZED CONTENT AND METHOD FOR SPRAYING A PRESSURIZED CONTENT

The invention relates to an actuator for a dispenser device for spraying content of a receptacle that is pressurized or of a receptacle that has a pump, comprising a channel connectable to a receptacle outlet on one side of the actuator for receiving the pressurized content of the receptacle, said actuator having an orifice for spraying the contents on another side of the actuator connectable with the channel. The invention also relates to an assembly of an actuator and receptacle as well as to a method for spraying a pressurized content of a receptacle.

In this respect one may think an aerosol can, a vessel or a bag-in-box, be filled with a fluid to be sprayed. This fluid may be a gas as well as a liquid. When a fluid is a liquid, this may also be a viscous liquid. In this patent application 'a fluid' is also understood to mean a cream, paste, gel, powdery substance and possible combinations thereof. Known examples are aerosol cans for spraying an atomized liquid, hair products, products suitable for consumption, etc. The receptacle contains the fluid to be sprayed mixed with a pressurized, compressible gas, preferably air or an inert propellant, such as nitrogen. A mixed substance is to be understood as at least two substances in one container space.

The invention relates specifically to actuators for use on receptacles having a propellant such as air or inert gasses, as well as $CO_2$, $N_xO$, etc. filling mixed with a fluid to be sprayed.

The orifice of the actuator is adapted for spraying the mix of propellant and fluid. A channel in the actuator is connected to the orifice for creating a flow of contents from the outlet of the receptacle to the orifice.

From U.S. Pat. No. 5,624,055 a device is known for dispensing and spraying the contents of a receptacle that is pressurized or has a pump. The actuator is connected as dispensing head to the outlet of the receptacle. The actuator has a switch connected to a shutter which is mounted slidably in the actuator. The shutter closes the orifice. An actuator is coupled directly with the shutter for opening the orifice, resulting in spraying the contents flowing through the actuator.

A problem of known devices, in particular a known actuator for use with a receptacle having an air or inert propellant mixture, is the clogging of the especially 'sticky' products/fluids such as a hairspray or hair lacquer in or on the actuator, in particular near the orifice. In prior art system this problem is avoided by the use of other, environment hazardous propellants.

U.S. Pat. No. 5,158,215 discloses an actuator having a volume chamber directly connected to the orifice. The actuator is mounted on a receptacle. A channel is connected to the receptacle outlet. A creamy substance is released from the receptacle into the channel when the actuator is pressed and moved towards the receptacle. The channel is connected to the volume chamber receiving a moveable body biased to close the orifice. The released substance will flow into the chamber resulting in a pressure build up. The pressure will rise slowly and overcome the fixed bias closing the orifice. Further this actuator is suitable for dispensing a substance, not for spraying.

An object of the invention according to a first aspect is to provide a solution to the clogging of the sprayed substance. According to a second aspect the invention also provides an actuator having an improved spraying pattern, in particular a spraying pattern indifferent of the filling or state of the receptacle. This includes known problems, such as spitting.

According to a third aspect the actuator is to be used with non-pollutant, e.g. air or nitrogen, propellants.

At least one of these and/or other objects are obtained by an actuator according to claim 1. In a rest state the orifice is closed. A biasing means closes the valve. Actuation however attenuates the bias. This allows the valve to be opened more easily. Preferably a build up of pressure in the volume chamber, directly connected to the valve/orifice will lead to a burst or explosive opening of the valve/orifice. According to the invention the valve/orifice is not directly opened by actuation, but is indirectly opened in combination with a attenuation or lowering of the bias for closing. Actuation is coupled with release of the contents from the receptacle into the applicator.

Also attenuation or release of the bias closing the orifice will result in the possibility of opening the valve/orifice with a relative low force. Such a force for opening the valve/orifice can be obtained from the flow of contents, even if the pressure in the receptacle is low. Contrary to U.S. Pat. No. 5,158,215 the lowering of the bias will result in the possibility of having a well closed valve under the influence of the bias in the non-actuated state. The bias can be relatively high. Actuation releases/attenuates the bias, allowing also the use of the applicator when the pressure in the receptacle is dropped. U.S. Pat. No. 5,158,215 will not function if the pressure in the receptacle is low.

Contrary to U.S. Pat. No. 5,158,215 the pressure in the volume chamber has to rise only a very limited amount in order to open the orifice. The orifice will shoot open.

The release of the contents into the applicator is preferably almost instantaneous with the actuation. As the valve of the orifice is not opened directly, the flow of contents is probably halted at least a finite moment in the volume chamber, allowing a pressure build up in that chamber. This will allow a burst of content out of the opening of the valve if the valve is eventually opened, e.g. after reaching a threshold value for the pressure in the volume chamber, e.g. a over pressure with respect to the outside. The threshold pressure can be an infinitesimal pressure difference between volume chamber and outside.

The burst of content out of the orifice already pressurized prevents or reduces spitting effects. Since the orifice is connected directly to the volume chamber wherein the contents is collected directly after actuation and since the valve is not opened directly—actuation is followed by the bias attenuation or release—subsequent opening of the valve will occur after a pressure build up.

An actuator for a dispenser according to the invention comprises a volume chamber. The volume chamber can be part of the channel in the actuator. In the volume chamber, the contents of the receptacle can be collected. Preferably the orifice forms an outlet of the volume chamber. The volume chamber in the channel is positioned directly upstream from the orifice. If the contents in the volume chamber is allowed to flow out, it will be sprayed/dispensed from the orifice. The orifice can be an interchangeable part of the actuator. Preferably the orifice is provided with swirls for swirling the substance to be sprayed when passing through and leaving the orifice.

According to a preferred embodiment the orifice has a valve for opening and closing the orifice or outlet of the volume chamber. This allows for a build-up of pressure in the volume chamber. In a preferred embodiment the valve is biased by biasing means in the closed position of the valve, preventing the flow of substance through the channel in the position of rest of the actuator. The biasing means also close the valve after actuation has ended.

The valve is preferably coupled with a pressure sensor element for opening the valve upon reaching a threshold pressure in the volume chamber. This allows for a build-up of pressure in the chamber directly stream upwards from the orifice. Only after reaching a threshold value, the orifice is opened for spraying the contents. This retardation prevents a slow start of the spraying of the contents, when a user wishes to start spraying. The pressure at the orifice jumps directly to a desired over pressure corresponding to the over pressure in the chamber.

The prior art system involving an orifice valve is operated directly from the start of the spraying. The actuation itself is linked with the direct opening of the orifice. According to the invention such a direct coupling is not present. This allows for a pressure build up in the volume chamber before the orifice is opened.

It has been recognized that a direct build up of pressure near the orifice in the actuator prevents the spitting of a sticky substance in actuator, diminishing subsequent use. Clogging is prevented since the orifice itself is closed with the valve, preventing air intake after actuation.

In an embodiment the biasing means for closing the orifice are set a predetermined force or corresponding threshold pressure. The threshold pressure corresponds e.g. to a 0, 5-20 Ato, preferably 1-12 Ato. If this pressure is build up in the chamber, the valve will be released.

In an embodiment, since the valve is biased for closing, a lowering of the pressure, e.g. the result of the user ending a spraying session, i.e. at the end of actuation, wherein the flow of substance through the channel is stopped, directly cuts of the spraying action. In an embodiment the orifice is closed as soon as the pressure in the volume chamber adjacent the orifice drops under the threshold pressure. This prevents a low-pressure last spray from the orifice, directly after the user stops spraying. The orifice/actuator has a closed state and an opened state.

The spraying or dispensing can be initiated by the user pushing the actuator, resulting in the opening of the outlet of the receptacle. The actuator itself doesn't necessary have means to initiate or stop the flow of substance from the receptacle. The contents of the receptacle flow into the inlet of the actuator through the channel and is collected in the chamber. A pressure builds up. The pressure build up is sensed and from reaching the threshold value, the valve closing the orifice is opened, that orifice also being the outlet of the chamber.

The pressure sensor element can be an electrical instrument coupled with a control for opening the valve. The pressure element can also be coupled with the biasing means for closing the valve, releasing the bias if a threshold pressure is reached.

In a preferred embodiment the biasing means closing the orifice are attenuated if the actuator is actuated. The actuation means are coupled with the biasing means. Actuation will attenuate or release the bias. Preferably actuation results in a flow of contents from the receptacle through the channel and into the volume chamber. This results in a direct pressure build up in the volume chamber. Initially the orifice is still closed by the valve. In a state of rest, no actuation, the biasing means closes the valve/orifice. Actuation results in release or at least lowering of the bias on the valve. If e.g. a threshold pressure is obtained in the volume chamber, the valve bursts open. Because of the attenuation or release of the bias on the valve, this threshold pressure is considerably lower than the pressure needed e.g. to open the orifice according to U.S. Pat. No. 5,158,215. Since the pressure in the volume chamber is higher than the outside pressure, no or less spitting occurs.

In a preferred embodiment the volume chamber is an expandable volume chamber. The volume can be expanded in that at least one wall of the volume chamber is moveably mounted in the actuator. In another embodiment the volume chamber has at least one flexible wall, that can be elastically deformed. This also allows the volume chamber to have a small volume in the unexpanded state. A relatively small volume is filled for building up a pressure after actuation. The volume of the chamber from inlet to outlet is preferably less than 20 $mm^2$, more preferably less than 10 $mm^2$, or even less than 5 $mm^3$, and most advantageously less than 3 $mm^3$.

It is advantageous to have the pressure sensor element coupled with the expandable volume chamber. This allows the pressure sensor element to sense the expansion. The expansion corresponds to a pressure build-up in the volume chamber, and thus reaching a certain amount of expansion corresponds to reaching the threshold pressure for opening and closing the valve. An arm could be coupled with the pressure sensor, for sensing a predetermined amount of expansion, initiating the opening of the valve.

Preferably the pressure sensor element has a surface, and the surface forms a moveable wall of the expandable volume chamber. If the wall is moved over a certain amount, e.g. overcoming a certain biasing force on said wall/surface, this indicates reaching a threshold pressure in the volume chamber.

In a preferred embodiment the valve is adapted to essentially directly open the orifice completely. This could be a fast shutter. This allows the build-up pressure in the chamber to be immediately released through the orifice if opened.

The biasing means closing the valve are preferably the same biasing means for bringing the expandable volume chamber to an unexpanded state. Preferably the biasing means are coupled with a wall of the expandable volume chamber.

The biasing means could also be coupled with the moveable wall of the expandable chamber for biasing said wall in an unexpanded position of the chamber. The volume chamber is then biased in the unexpanded position.

In a preferred embodiment the valve comprises a piston having a piston body that is mounted moveable in the actuator, wherein the piston is received in and coupled with the actuator. The piston extends in the orifice and blocks the orifice in the closed/biased position. In the idle or standly position/state, the unexpanded chamber has a considerable smaller volume than prior art.

The biasing means in a further embodiment are adapted for biasing the piston in a position closing the orifice. The biasing means can comprise spring means e.g. a leaf spring. The spring can be attached to the actuator, received in the actuator. In another embodiment the biasing means could be a gas chamber having a certain pressure.

If the actuator is actuated by a user, preferably the biasing means on at least the valve and preferably also on the wall of the expandable volume chamber, are released or lowered. After actuation the bias closing the valve is lowered or attenuated or even reduced to zero. This allows the valve to burst open, e.g. after reaching a threshold pressure.

Preferably a situation is created wherein the piston is in a position of unexpanded volume chamber and closed valve but released of bias for closing. After actuation the pressure in the volume chamber increases. The piston is preferably received in the actuator generally free of friction. After release from the biasing means, it is only its moment of inertia keeping the piston positioned. A pressure build up can overcome the moment of inertia, simultaneously expanding the volume chamber and opening the valve. In a further preferred embodiment the size of the inlet is also simultaneously reduced.

It is preferred to adapt the piston so that it also forms the pressure sensor element. The piston forms e.g. the moveable wall of the expansion chamber. If the pressure build up in the chamber reaches a threshold value, the piston body moves. In an embodiment biasing means are still coupled with the piston and this threshold value includes the influence of the biasing means.

Favorably the piston has a pin extending from the piston body forming the valve for closing the orifice, resulting in the direct movement of the piston tip and opening the orifice if the threshold pressure value is reached.

The piston body is received in the volume chamber. The piston body is connected with the piston and moves if the volume chamber is expanded. The flexible element, preferably the O-ring is mounted on the piston body. The piston body moves past the inlet. The flexible element moves partly in the inlet and blocks part of the inlet, reducing the inlet in size.

At least one of the and/or other objects are obtained with an actuator wherein an inlet connects the channel with a volume chamber, wherein the orifice has a valve for opening and closing the orifice, the valve biased by biasing means in the closed position, wherein the inlet has inlet reduction means for reducing the size of the inlet to the volume chamber, characterized in that the inlet reduction means comprises a flexible element. The flexible element, preferably the O-ring that forms a wall of the inlet, is a more flexible wall part then e.g. a ring of the body according to U.S. Pat. No. 5,158,215. The flexibility of the element or O-ring allows a fast change of the size of the inlet, allowing to obtain a more stable pressure in the volume chamber. The size of the inlet is quickly adaptable. This in turn reduces stabilizes the pressure in the volume chamber and reduces spitting effects from the orifice.

In an embodiment the piston body has a surface that forms the volume chamber wall, said surface extending preferably freely into the volume chamber in the closed state and the piston being moveable preferably acute to said surface. The surface dimensions and the force exerted by the biasing means correspond with the threshold value that should be reached to open the orifice.

It is further favored to have the actuator comprise guiding means for guiding the pin onto/into the orifice. This ascertains the movement of the pin back to the closed state if the pressure in the chamber drops under the threshold value.

In combination with the orifice closing/opening or separately, it is preferred to have an actuator comprising inlet reduction means for reducing the size of an inlet to the channel and preferably to the volume chamber. The inlet closing means preferably reduce the inlet to the channel/chamber in an opened state of the orifice. The reduction of the inlet will lead to the decrease of pressure in the volume chamber. This reduces the pressure in the volume chamber under the pressure of the receptacle. This lowering and in turn controlling of the pressure in the actuator leads to better spraying patterns. The reduction of the inlet also stabilizes the pressure of the entire assembly of actuator and receptacle as known from EP 1 200 322, which is included by reference.

Preferably the pressure sensor element is coupled to the inlet reduction means for reducing the inlet. Preferably the size of the inlet is reduced. The reduction can be coupled with the same or a different threshold pressure in the volume chamber.

In a different embodiment the actuator comprises inlet enlargement means for enlarging the size of an inlet to the volume chamber in an closed state of the orifice, preferably in a transition from the opened state to the closed state. These enlargement means can be coupled to the biasing means or with secondary biasing means.

In an embodiment the pressure sensor element is coupled to the inlet enlargement means for enlarging the inlet size upon reaching a threshold pressure in the volume chamber.

Preferably the actuator according to the invention comprises first biasing means for at least closing the valve and preferably also for un-expanding/reducing the volume chamber. Preferably the first biasing means are brought in an inactive or reduced state after actuation. These first biasing means operate to bring the piston in a position of rest. The actuator comprises second biasing means preferably also operable on the piston for control of the inlet reduction. Preferably the second biasing means work on the piston only after allowing the piston to have a bias-free state. This allows the piston to burst open after a pressure build up in the volume chamber. In this manner a two-step biasing is obtained.

The second biasing means are arranged to bias against closing the inlet of the volume chamber. Preferably the second biasing means are non-linear resilient means. Preferably a biasing means in the form disk-shaped resilient material is used. Such a biasing means have non linear properties.

Preferably the piston is received in an aperture of the disk. Such a biasing means is also a sealing means. The engagement of the disk on the piston is tight and prevents leakage, e.g. of the contents.

Preferably the disk is received and fixed in the house of the actuator. Preferably the disk is received in the house and positioned as a cone, with the tip of the cone directed towards the biasing direction. This allows the second biasing means to obtain preferably properties having a steep, preferably exponential resilient strength.

It is advantageous to form the inlet to the volume chamber in the channel between the piston body and an interior, preferably a circular interior, wall of the actuator. This allows the use of the piston body for enlarging or reducing the inlet surface area in use during a transition from the closed state to the opened state and back.

Preferably a seal, such as a flat seal or O-ring is mounted on the piston and the seal, preferably the O-ring is adapted to reduce the size of the inlet of the volume chamber in the opened state. The O-ring forming a wall of the inlet is a more flexible wall part then e.g. a solid ring body according to U.S. Pat. No. 5,158,215. The flexibility of the O-ring allows a fast change of the size of the inlet, allowing to obtain a more stable pressure in the volume chamber. The flexibility of the O-ring compensates for quick pressure changes arising the volume chamber. This in turn reduces spitting effects.

The O-ring is preferably mounted on the piston body. The piston body is preferably circular. The piston body with O-ring extends in the volume chamber. If a pressure is exerted on the piston the piston moves out of the volume chamber and the O-ring reduces the size of the inlet. Preferably the movement of the piston and O-ring is limited so that the O-ring does not fully block the inlet.

The O-ring is made of a more flexible material than the hard plastic used for the housing parts and/or piston. The flexibility of the O-ring allows the O-ring to quickly adapt to sudden pressure changes, in particular to local pressure changes. The flexibility of the material allows the inlet, even though basically circular, to have locally different forms. This further prevents sputtering if the actuator is used.

The O-ring and a wall of the actuator form the inlet reduction means. Since the O-ring is moveably mounted in the applicator, this is a main first adaption mean for reducing/ enlarging the inlet. Moving the complete piston with O-ring will have an influence on the complete size/surface area of the inlet. The flexibility of O-ring allows, on top of the overall size reduction/enlargement, a local adaption by allowing bending of the O-ring. If for some reason, after actuation, the pressure of the content flowing from the receptacle into the channel and volume chamber increases, the flexible O-ring can adapt to the new pressure quickly. Local pressure density differences can be adapted also.

It was found that the distance between the position of the O-ring in the state of rest of the applicator and the pressure control position during actuation is a measure for the amount of flow in the applicator. This corresponds with the length of the piston extending into the volume chamber beyond the O-ring. A piston extending more into the volume chamber, will result in a smaller distance for the O-ring to travel between the state of rest and state of actuation, wherein the inlet is reduced, and the flow rate of the contents will be reduced. In another embodiment the second biasing means biased for enlarging the inlet can be varied. When a larger bias is used, the inlet will be opened more, allowing a higher flow rate. With the invention it is possible to adapt any flow rate. The O-ring and the second biasing means allow a more or less constant flow rate.

In a preferred embodiment the orifice cross sectional surface area is more than five time smaller than the volume chambers inlet cross sectional surface area. This allows the actuator to control in a limited fashion the pressure release from the receptacle. In steps the pressure in the receptacle is reduced. In a first step the pressure is reduced to a pressure close to the threshold pressure in the volume chamber. The small orifice allows another pressure drop from the volume chamber pressure to the outside pressure. These pressure steps allow a better and more constant spraying pattern independent of the amount of the pressure in the receptacle.

According to yet another aspect the actuator comprises at least an actuator hood, a first part receivable in the actuator hood having the orifice and the channel's inlet, a second part receivable in the first part for forming the channel from the inlet to the orifice and the piston receivable in the second part. These parts can be produced using injection moulding. Subsequent parts are received in the interior of the respective covers.

In another embodiment the actuator hood comprises the orifice and channel inlet.

Further the actuator can comprise a third part received in the second part for locking a spring that engages on the piston body biasing the piston for closing the orifice. The spring can engage on the flange of the piston body, preferably a circular surrounding flange extending outwardly from the piston body, while the spring is formed by helical spring surrounding the piston body.

The invention also relates to an assembly of a pressurized receptacle and actuator comprising an actuator connected with the outlet of the receptacle. The receptacle can contain a pressurized content or has a pump for creating a pressure. The receptacle outlet can be opened. A flow of pressurized content, preferably mixed with a fluid such a air or nitrogen or another suitable non-toxic propellant. The receptacle outlet is coupled with the actuator inlet to a channel through the actuator. The channel connects the actuator inlet with an orifice for spraying the content mixture.

The invention also relates to a method for spraying contents of a receptacle comprising, providing a receptacle having contents that is pressurized or of a receptacle having a pump, flowing the pressurized contents into a volume chamber, building up of pressure in the volume chamber, opening an outlet of the volume chamber formed by an orifice for spraying the contents after reaching a threshold pressure in the volume chamber. This allows the spraying to be released at or near the threshold pressure, ensuring a better spraying pattern and resulting in less clogging of the contents on the actuator for spraying.

Preferably the bias on the valve is released or attenuated after actuation. The valve is however not opened by actuation. The valve with no or minor bias towards the closed position is allowed to open due to a property of the in flowing contents into the volume chamber, preferably the building up of a pressure in the volume chamber. After reaching a threshold pressure, the valve can burst open, creating less sputtering. Contrary to U.S. Pat. No. 5,158,215 the lowering of the bias for closing the valve allows a burst opening of the valve/piston.

Preferably the volume chamber is expanded by the flow of contents into the volume chamber. Preferably a wall of the volume chamber moves to expand the volume chamber. Preferably the wall and/or volume chamber is biased to the unexpanded state. Preferably the moving wall of the volume chamber couples the expansion to the opening of the orifice.

In a preferred embodiment opening the orifice and expanding the volume chamber is performed simultaneous. Preferably an integral body is used therefor.

Preferably the method also comprises reducing the size of the inlet to the volume chamber.

It is advantageous to couple the expansion of the chamber to reducing the size of the inlet, preferably the inlet to the volume chamber. This limits the flow to the volume chamber leading to a pressure reduction in the volume chamber. Preferably an integral body is used therefor.

The invention also relates to a gasket for use in applicators for dispensing fluids. The gasket is made of a resilient material. The gasket surrounds a moving part of the actuator or of a part in a receptacle. The gasket is provided with a opening. The gasket is preferably a disk shaped piece of material with a center hole. The gasket is placed acuate or oblique to the direction of movement of the part, in particular of a piston. The gasket is a biasing means for forcing the part in a particular position. The gasket replaces a combination of a O-ring and e.g. a spring. The gasket is both a means for biasing and for sealing. Such gaskets can be used in several applications. The use of such a gasket for biasing will save the use separate O-rings and springs.

The invention further relates to an applicator comprising a first part having an actuation surface and for receiving a second part having an inlet on one side and an outlet on an other side, wherein the outlet can comprise an orifice. The second part comprises a receiving space for a third part. In between the second and third part a volume chamber is formed, wherein the orifice is an outlet of the volume chamber.

Further a piston is receivable and moveable in the third and/or second part. The piston also forms a moving wall of the volume chamber, the volume chamber being expandable. A biasing means is connectable to any of the housing parts for biasing the piston in a position of unexpanded volume chamber. Preferably the third housing part comprises a channel for connecting the inlet of the second part with the volume chamber. Preferably the piston comprises a tip forming a valve of the orifice.

A second biasing means can be provided between the third housing part and the piston. A fourth housing part can be used to confine the second biasing means. The fourth housing part can be used to limit the movement of the piston. The fourth housing part can be mounted to close of the receiving space of the third and/or second housing part.

The actuator according to the invention comprises fixing means for fixing the different housing parts into each other. This allows a quick and easy assembly of the actuator. Since the different housing parts are received into each other, the actuator is easily assembled. Preferably a clicking system is used for fixing the connections. The parts can be manufactured using injection molding. This allows production of the housing parts with small tolerances.

The invention is disclosed using preferred embodiments. The person skilled in the art will understand however that several modifications of the embodiments are possible within the scope of protection, defined solely by the appended claims. Divisional applications are possible, for example relating to the inlet reduction, possibly in combination with the expanding volume chamber or moving piston.

The invention will now be described in conjunction with the figures, wherein:

FIG. 5 shows a table with experimental results.

Figure 1:
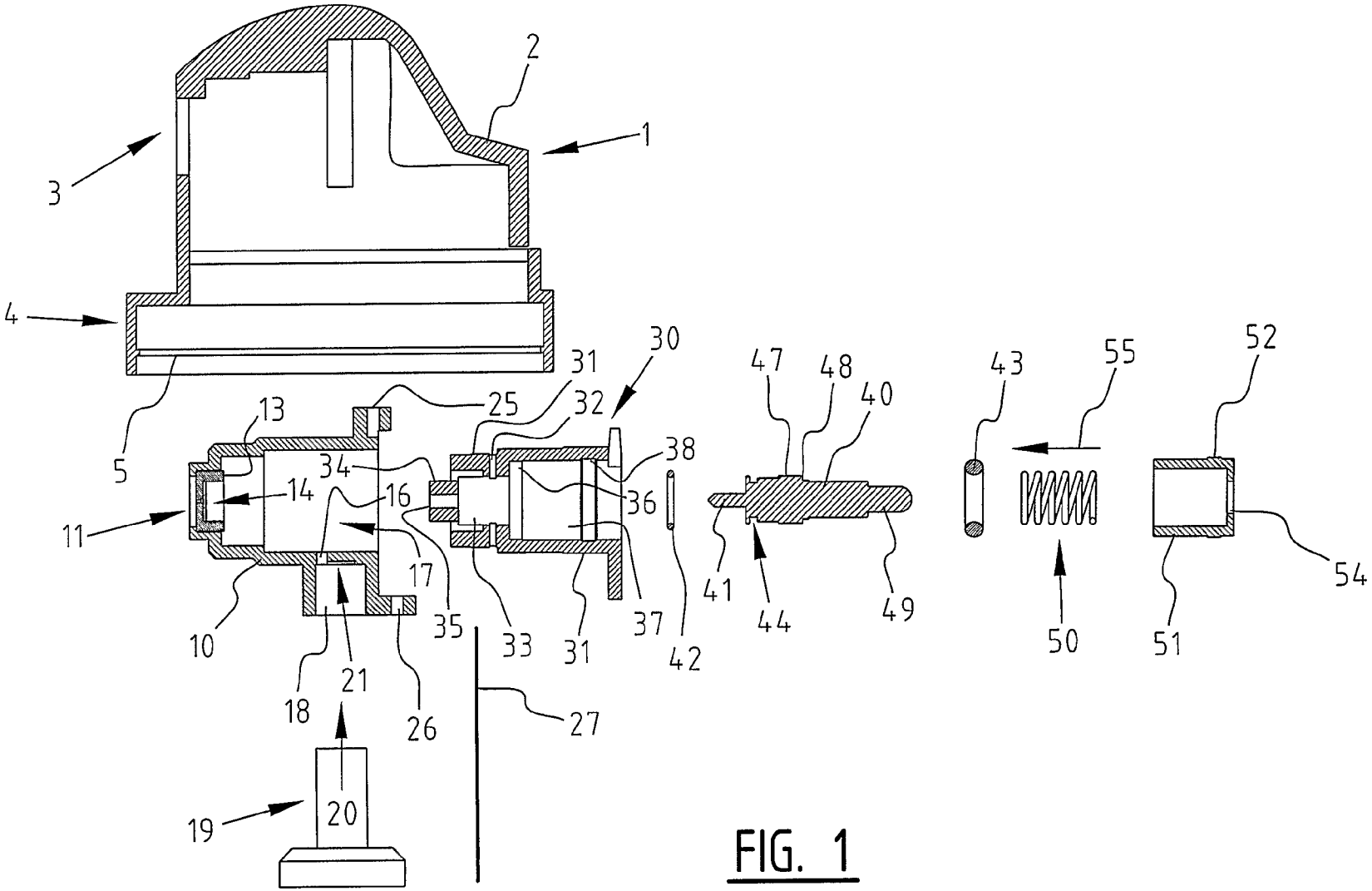
FIG. 1 shows a first embodiment of the actuator according to the invention.

FIG. 1 shows the elements of an actuator according to a first embodiment. The actuator comprises an actuator hood 1 adapted to be fitted on top of a receptacle for spraying a substance. The actuator hood 1 comprises a press area 2 that the user can press in order to activate an assembly of actuator and receptacle for spraying or atomizing a substance.

The actuator hood 1 is produced using an injection moulding technique. The hood 1 comprises an opening 3, wherein the orifice for spraying the substance can be received. The hood or cap 1 can be mounted on top of a receptacle and comprises a snap-on or clamping circular area 4 for clamping on the top part of a similar circular receptacle. A clamping flange 5 is formed on the inner side of the area 4. Other cross sections for hood 1 and receptacle are possible. The skilled person will be able to adapt the actuator to a corresponding receptacle.

The actuator hood 1 is made of a flexible plastic. Other materials could be used. The hood 1 is primarily hollow in order to receive other parts of the actuator.

A first part 10 has outside walls corresponding to the interior wall of hood 1 to be received in the interior of hood 1. First part 10 comprises the orifice 11 formed by a small opening in part 13. Part 13 could be an interchangeable part in order to differentiate the cross section of the orifice during manufacturing. By using a separate part 13 it is possible to mass produce first 10 and still obtain different orifices 11. Part 13 is locked into the opening 14 of first part 13. Part 13 has of general circular section.

In another embodiment part 13 is integral with part 10.

Near the orifice, on the inside of the applicator a number of more or less radial channels (not shown) are formed around the orifice. These channels offer a swirling effect of the fluid to be dispensed, causing a better atomization or spraying. Since the orifice 11 is closed directly by a valve formed by a pin 41 extending into the orifice, these channels will not clog since closing the orifice shut down any air supply to these channels.

First part 10 is shown in cross section, as are the other elements in FIG. 1. In the cross section an opening 16 connects the interior space 17 of first part 16 with the inlet space 18. Inlet space 18 comprises a space wherein the outlet 19 of a receptacle can be received in. The cross section of space 18 corresponds with the outlet cross section 19. The outlet 19 comprises a push button known per se, located on top of an aerosol can. The outlet 19 can comprises a shut-off valve for opening and closing the outlet. The shut-off valve is opened when, in the assembled state, a user presses the actuator down or sidewards on press area 2 of the actuator hood 1.

The receptacle or package is not shown in FIG. 1 is partially filled with a fluid possibly a liquid. The fluid is the product to be dispensed. The inner space of the receptacle can be filled with for example 85% liquid. In the remaining space of the inner space 10 an inert gas is present such as for example nitrogen. By means of the inert gas or any other propellant there is created in the inner space of the receptacle a high pressure for dispensing the liquid via the outlet 19, when the push button/actuator is actuated.

The outlet 19 dispenses the liquid/gas mixture from the top according to arrow 20. The mixture will be received in the first part 10 in the conduit 21 formed on top of space 18. From there the mixture will flow to the inlet opening 16.

Further the first part 10 comprises two receiving spaces 25,26 formed on the top and bottom end of the first part. The receiving spaces are adapted to hold a leaf spring 27 as will be described in more detail in the following.

In the interior space 17 a second part 30 can be received. Second part 30 can be manufactured using injection moulding, but also other techniques can be used.

The second part 30 is designed primarily as a guiding means for the piston 40. The second part, together with the first part form the volume chamber of the invention.

Second part 30 has a conduit 32 leading from the outer side to the interior space 33. The second part 30 has a outside ridge 31 to engage and seal on the interior wall of the first part 10.

The second part 30 has means for guiding the piston tip 34. The means comprise an opening 35 wherein the piston tip 41 can be received. The opening 35 comprises a tunnel directed at the orifice 11 is the assembled state.

The piston 40 is received in the inner space 37 and space 33 of the second part 30. The piston tip 41 extends into the space 33 and into the opening 35. The piston comprises two O-rings 42,43 both having preferably a circular cross section. The piston can be completely cylindrical.

The seal, here O-ring 42 is received in the circular groove 44 on the piston body. The piston pin 41 extends beyond the groove 44.

O-ring 43 is placed and clamps around piston 40 on the side 47. O-ring 43 will act as a seal sealing space 33 from space 37 if the piston 40 is received in the second part 30. The O-ring 43 is received in the area 36 in second part 30.

A helical spring 50 and a closing body 51 can be received space 37 enclosing the piston 40 in the interior space of part 30. Closing body 51 has a ridge 52 that can be received in groove 38 in part 30 providing a snap connection locking the closing body 51 in the interior of second part 30.

The spring 50 surrounds the body of piston 40 biasing the piston in the direction of arrow 55 towards the orifice 11. Spring 50 engages on edge 48 of the piston.

In another embodiment spring 50 is shorter. The piston 40 is only biased by the first biasing means, spring leaf 27 in the closed position/position of rest. After actuation the spring leaf 27 will bend away and the bias will be released. The piston is then allowed to move more or less freely according to arrow 55.

The piston end part 49 extends through the opening 54 of the closing body 51. The spring leaf 27 will engage on this end and will also form a, or in an more preferred embodiment form the only the single biasing means forcing the piston in the direction of arrow 55. The spring 50 is a biasing means for closing the valve. In a preferred embodiment spring 50 is not a biasing means for closing the orifice, but is a biasing means only for preventing the closing of the inlet 64 of the volume chamber as will be explained hereunder.

The leaf spring 27 biases the valve in the closed position. Spring 50 can also bias the volume chambers in the non-expanded state. Leaf spring 27 is bended if a user exerts force on area 2, allowing movement of the piston according to arrow 55. Actuation by a user is directly coupled to releasing the bias on the piston exerted by biasing means 27.

If the user stops pushing the actuator 1, the spring leaf immediately closes the valve pushing the piston on the orifice. The spring 50 holds the closed state directly, but temporally after actuation. The force exerted by leaf spring 27 corresponds to multiple time the force needed to close the orifice or to move the piston to the non-expanded state of the volume chamber 71.

Figure 2:
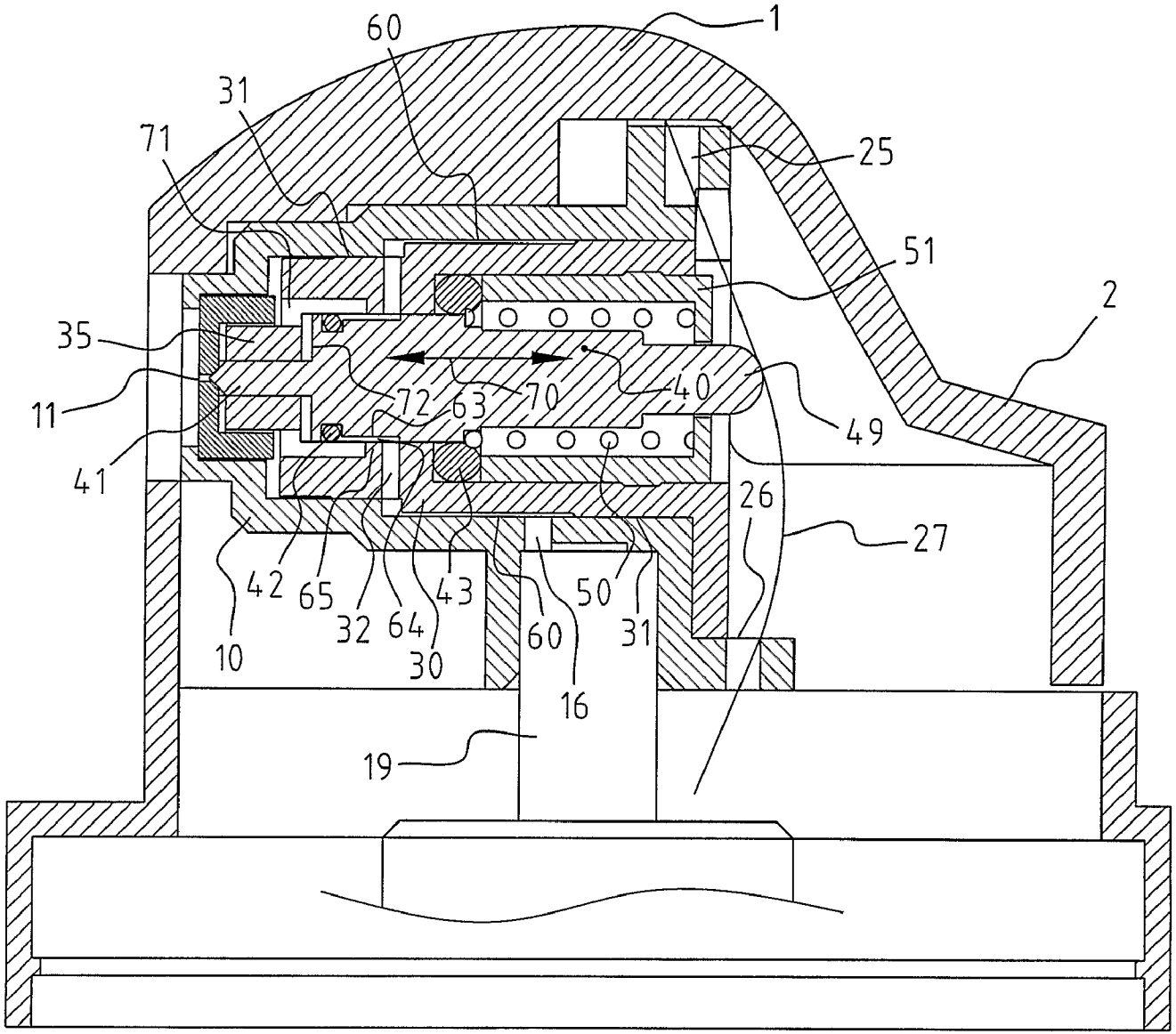
FIG. 2 shows a first embodiment of an assembly according to the invention in a closed state.

FIG. 2 shows the actuator hood in the assembled state, placed on the outlet 19 of a receptacle. Now the channel or conduit formed in the actuator will be discussed.

From the outlet 19 the content of the receptacle is guided to the orifice 11. It will first be received in space 21 and guided to the inlet 16.

From the inlet 16 ridge 31 seals off the flow to the right side as shown in FIG. 2. Tolerances in mass-production allow the manufacture of such sealing using two moulded pieces such as first part 10 and second part 30.

The content can in this embodiment only flow through the opening 60 surround the second part 30 and surrounded by the interior wall of the first part 10.

The opening 60 is connected with opening 32 in the second part 30. From the opening 32 the flow can continue through the inlet 64 between the piston 40 and second part 30. The inlet 64 is formed by side 63 of the piston and ridge 65 extending inwards from the second part 30.

The inlet 64 has extends circularly around the piston body 40 and between the ridge 65. Even if the piston is moved a fraction sideways according to arrow 70, the inlet 64 maintains its original size.

Piston 40 seals of the central part in actuator. For as far as the fluid can penetrate the space 37, O-ring 43 engages on the piston 40, sealing off any fluid path.

From the inlet 64, the fluid can flow into the volume chamber 71, surrounding the piston 40 and O-ring 42, and received in the second part 30 and first part 10. The wall surrounding orifice 11 forms the lefthand side wall. Another ridge 31 of second part 30 engages on part 10 and seals off any fluid path between the two parts.

Figure 3:
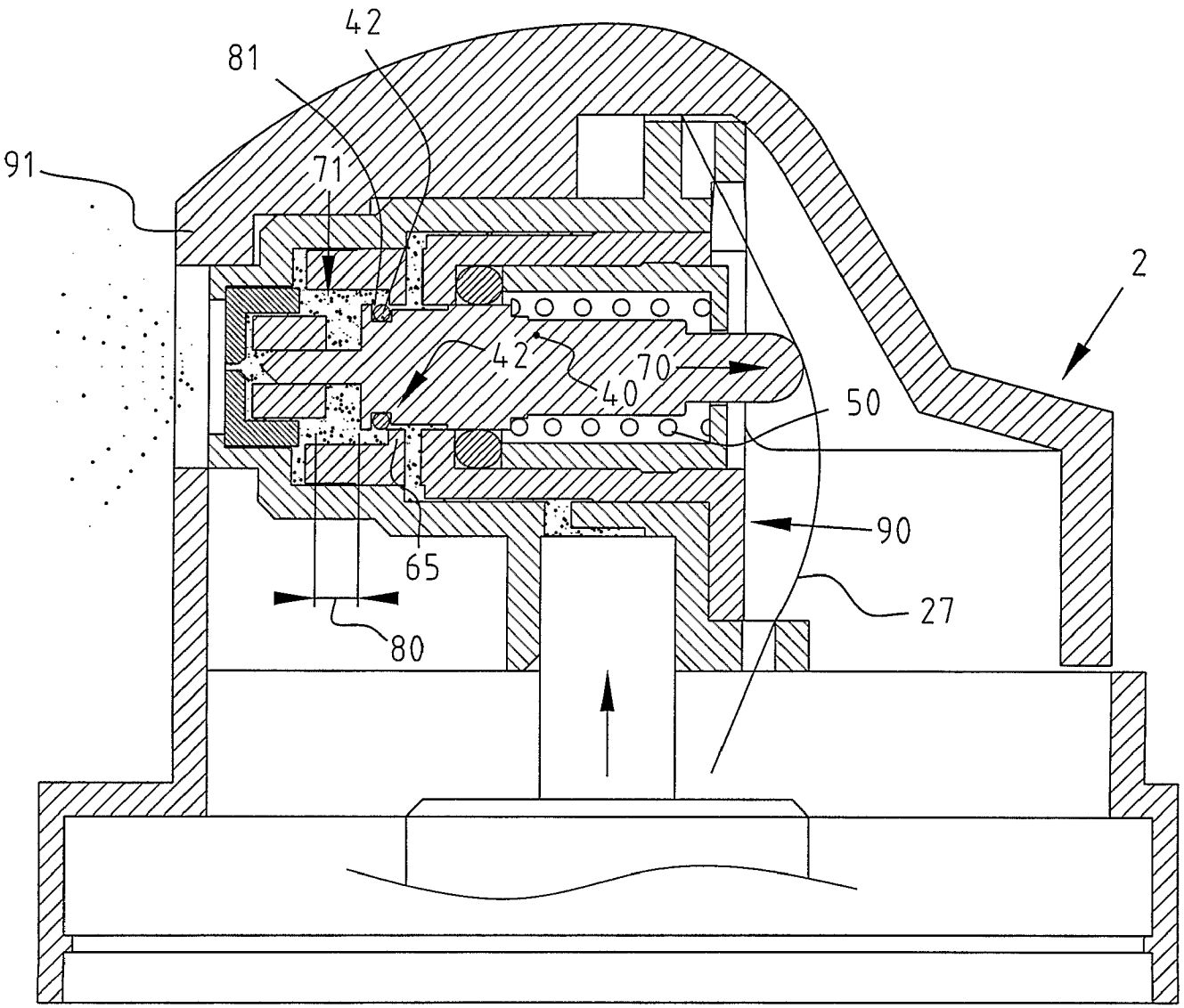
FIG. 3 shows a first embodiment of an assembly according to the invention in a opened state.

In operation, as shown in FIG. 3, the volume chamber fills up. A pressure build up occurs.

Piston 40 extends into the volume chamber. The piston pin 41 extends into the guiding means 35 into the orifice 11. The orifice 11 is closed by the tip. The tip is received in the orifice.

Since the piston 40 has a circular surface 72 surrounding the piston pin 41, and since the piston 40 is mounted moveably in the actuator according to arrow 70, the pressure build up in the volume chamber 71 will exert a pressure on said surface 72 against the biasing means formed by spring 50 and spring leaf 27 or only formed by the spring leaf 27. These (this) spring(s) bias(es) the piston in the direction of the orifice, closing the orifice.

The spring(s) exert(s) a force on the piston. This force in conjunction with the surface area of surface 72 correspond with the threshold pressure needed to overcome the biasing by these springs. When the pressure in chamber 71 has reached the threshold pressure, the piston 70 will move according to arrow 70, withdrawing the piston pin 41 out of the orifice and the orifice 11 will be opened. The piston pin 41 functions as a valve for opening and closing the orifice.

In another embodiment a pressure sensor element, such as a electrical instrument can be used. Other biasing means can be used, such as pressure chambers or other flexible materials. Springs are preferred, since the springs allow for fast reactions. The spraying pattern and the advantages according to the invention are preferably obtained when the orifice is opened quickly allowing a direct outflow of the fluid collected in the chamber 71. The valve according to the shown embodiment is of the type allowing an explosive opening. The valve could be replaced by a fast shutter.

The explosive character of the valve opening and closing the orifice in particular the valve also opening the outlet of the volume chamber, prevents the 'spitting' of fluid at the start and end of a spraying session of prior art actuators.

Contrary to prior art, the pressure sensor element, here embodied by the biasing means and piston, does not react to outside actuation, but react only to reaching a certain threshold pressure in the volume chamber. According to the invention the valve/orifice is not opened directly by actuation.

The threshold pressure can be an infinitesimal amount over pressure with respect to the outside. If the bias on piston is attenuated or released the piston is more or less freely moveable in the actuator. A small pressure build up from the fluid flowing into the volume chamber after actuation will cause the piston to move, for expansion of the chamber. A pressure build up will occur due to a small moment of inertia needed for movement of the piston and expansion of the chamber. The pressure build up in combination with the expanding volume chamber form the opening means for the valve/orifice.

The second biasing means, here a cylindrical spring 50 needs only to come into action when the inlet 64 of the volume chamber 71 is expanded. Preferably the actuator 1 has a two-step actuation, whereby after actuation by a user by exerting a force on actuation surface 2, a pressure build up of fluid entering a channel 16 through inlet 64, expands a volume chamber 71 that is directly connected with the orifice 11, wherein said expansion causes the valve closing the orifice to open. The expansion and/or the opening of the valve is possible since the bias for closing the valve or bringing the volume chamber to an unexpanded state is attenuated or released after actuation. After ending the actuation the bias on the volume chamber and/or the valve is increased and the actuator will take its position of rest as shown in FIG. 2.

In an embodiment the cylindrical spring exerts a biasing force on the piston 40 also directly after actuation towards closing the orifice.

The volume chamber 71 is allowed to expand, opposing the second biasing means 50. In the shown embodiment, one of the walls of the volume chamber, here surface 72 is formed by the moveable piston. Moving the wall expands the volume of the chamber.

Although illustrated with an embodiment wherein the expansion of the volume chamber is directly coupled via the piston and piston pin to open the valve, in an less preferred embodiment this coupling could be formed indirectly. The expandable chamber could have a 'moving' wall. When the wall moves, a sensor could sense this movement and signal the opening of the valve, e.g. by releasing the tension on the valve closing the orifice, by taking away the biasing means or interrupting the biasing means.

The flow of fluid is illustrated in FIG. 3. The fluid is atomized in the orifice 11. The volume chamber is located upstream from the orifice. The orifice is the outlet of the volume chamber.

FIG. 3 shows the actuator 1 having an inlet on one side 90 of the actuator, and having an orifice 11 on another side 91 of the actuator. In the actuator a channel is formed in and through the different parts of the actuator. The channel comprises a volume chamber 71 that is expandable. The channel also comprises an inlet to the volume chamber, the size of which is variable, dependent on the opened or closed state of the orifice, as will be discussed in the following. One wall of the channel is formed by the moveable piston. The wall is moveable against the biasing means.

Contrary to the prior art the orifice 11 is opened not directly e.g. by a coupling of pressing area 2 and the valve closing the orifice, but the orifice is opened only after pressure build up in a volume chamber in the actuator, directly upstream from the orifice.

From the receptacle the fluid is released into the actuator following actuation of a user that opens the receptacle outlet.

The fluid is first collected in a first chamber 32 formed in second part 30. From there, through inlet 64, the fluid is allowed into the expandable volume chamber 71. From an initial pressure in the receptacle, the pressure is lowered in three steps to outside pressure. The pressure in chamber 32 is lower than the pressure in the receptacle. The pressure in chamber 71 is lower than the pressure in chamber 32, but higher than outside.

The actuator according to the embodiment shown comprises yet another aspect that improves the spraying of the fluid. The O-ring 42 will, if the piston moves to expand the volume chamber 71, move towards the ridge 65. The inlet 64 between the piston wall 63 and ridge 65, will eventually reduce in size, if the O-ring 42 moves into the position shown in FIG. 3. The O-ring reduces the size of the inlet, allowing a further pressure difference between the volume chamber 71 on the one side and chamber 32 and the receptacle on the other side. This allows for a further improvement of the spraying pattern. The controlled lowering of the pressure in the fluid allows for a controlled flow.

The pressure difference with outside air and volume chamber 71 depends on the properties of the orifice. A preferred orifice works at 0.2-10 bar, preferably 0.4-5 bar, and more preferably 0.5-2.5 bar. Lowering the pressure difference allows a better spraying pattern. The piston/biasing means construction allows to obtain such lowered pressures independent of the filling level of the receptacle. The biasing means will only allow outflow of fluid from the orifice if the threshold pressure value is reached. The second threshold pressure will be dependent on the bias for closing the valve/keeping the volume chamber in an un-expanded state after actuation.

The full or nearly full release of the bias from the first biasing means 27 after actuation will allow the expansion of the volume chamber with a very small over pressure. This will allow spraying/dispensing of the fluid, even if the pressure in the receptacle is very low, contrary to the teachings from prior art.

In experiments it was measured that the inlet opening between O-ring 42 and ridge 65 was less than 0.1 mm for liquids, and preferably less than 0.05 mm for gases. The inlet to the volume chamber has preferably a width of 0.03-0.07 mm for liquids and 0.01-0.03 mm for gases.

FIG. 3 shows the working position of the actuator 1 during actuation. Directly after actuation a flow of fluid enters the actuator. The leaf spring 27, the first biasing means, is bended away according to arrow 70, allowing the piston to move freely according to arrow 70. At first however the piston 40 maintains the orifice closing position. Preferably the leaf spring will be release from all contact with the piston during actuation. After actuation the first biasing means will position the piston back in the position of rest according to FIG. 2.

FIG. 3 shows the piston being moved a distance 80 according to arrow 70. The orifice is opened. The surface area of inlet 81 is smaller than the inlet 64 in the position of rest.

FIG. 3 also shows that the second biasing means 50 are compressed by a distance 80 or less, exerting a force to counteract the opening. This bias is directed at enlarging the size of the inlet 81. The inlet enlarges if the pressure in volume chamber 71 decreases. The inlet is reduced if the pressure in the volume chamber 71 increases. This will arrange a more constant flow of fluid from the receptacle.

The O-ring 42 is brought into close proximity with wall 65. The O-ring is flexible and can be bended locally to adapt to local or quick pressure changes in the flow of fluid.

The spring properties of the helical spring 50 will determine the flow rate. If a more powerful second biasing means is used, the inlet will be larger, allowing a higher flow rate. The flow rate is adjustable by using a different second biasing means having different resilient properties.

Figure 4:
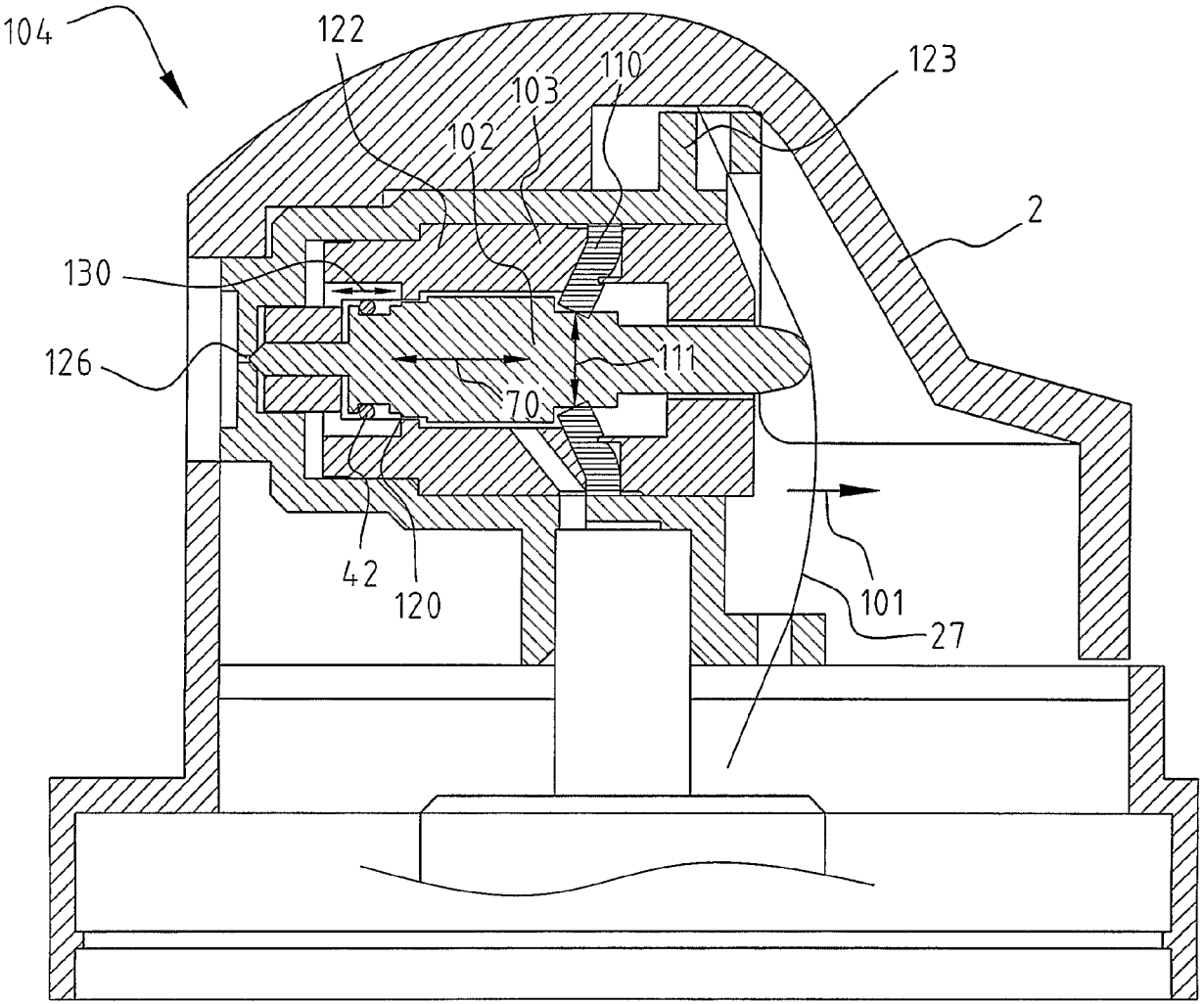
FIG. 4 shows a second embodiment of an assembly according to the invention.

FIG. 4 shows a second embodiment. Likewise parts are indicated with the same reference numerals. Upon actuation, a user pushes on surface 2, the leaf spring 27 will move according to arrow 101. The leaf spring, biasing the piston 102 in a direction opposite arrow 101, will no longer exert a biasing force on the piston 102. Upon actuation the biasing will be released or at least attenuated. The movement of the leaf spring is illustrated in FIG. 3.

A second biasing means 110 is received in the housing part 103 of the actuator 104. The second biasing means is a disk like shaped sheet of flexible material. In a aperture 111 of the disk, part of the piston is received.

The gasket 110 is both a biasing means and a seal, replacing the spring 50 and O-ring 43 of the first embodiment. Further the disk 110 has the preferred non linear properties when the piston moves according to arrow 70. In the shown position of rest in FIG. 4 no or very little force is needed to move the piston 70. This allows a burst opening of the orifice directly after actuation. The second biasing means do prevent the closing of inlet 120 by exerting a bias opposite arrow 101 on the piston.

The inlet 120 has a generally circular form. Walls of the inlet 120 to the expandable volume chamber are formed by housing parts and the piston, in particular the O-ring 42. The O-ring is made of a more flexible material than the housing parts. This allows the O-ring to quickly adapt to pressure changes occurring when the flow of contents into the volume chamber fluctuates.

Likewise the first embodiment, actuation of the second embodiment has two consecutive steps. When actuated the first step will open the stem of the valve shutting of the receptacle. This will create the channel and chamber to be filled up with product basically at the same pressure in the can. In particular the first biasing means (leaf spring) will keep the orifice closed.

Immediately further the actuator comes in a second position forcing the leaf spring 27 away 101 from the orifice. The pressure in the chamber will move the piston 40,102 according to arrow 70 and both the orifice 11 will open and the volume chamber 71 will expand. This creates a jet that not spits.

The person skilled in the art will identify that opening the stem of the receptacle requires less force than the further bending of a leaf spring. This sequence is therefore reproducible. Actuation of the device according to the invention is directly coupled with the release or attenuation of the bias to the closed position of the valve.

The piston 40,120 with the O-ring 42 has moved toward the wall 65. The inlet 64,120 stays open due to the biasing of the spring 50 or the gasket 110.

Compared to the first embodiments shown in FIG. 1-3, the volume of the channel, inlet and expandable volume chamber is more reduced, in particular with respect to the channel. The free space between two body parts 122, 123 in particular in the area before the inlet 120 is reduced.

In body part 123 a number of radial channels 124 are formed, preferably two or three, connecting the inlet 125 with inlet 120.

FIG. 4 also shows the orifice 126 as an integral part of body part 123.

The piston 102 extends a distance 130 beyond the O-ring 42. The distance 130 can be varied. The distance corresponds with a flow rate of the fluid, as will be illustrated with reference to FIG. 5*a*.

FIGS. 5*a* and 5*b* show experimental results. FIG. 5*a* shows the left over contents of the receptacle [ml] and spray of fluid from the orifice [g/sec]. A starting pressure in the receptacle is 11 bar. The distance (x) corresponds with distance 130 in FIG. 4. The distance is modified to obtain flow rate variants. The tables shows measurements at a linear time scale. The flow rate is more or less constant. The larger distance x becomes, the lower the flow rate. A higher 'x' will result in a smaller volume chamber. The pressure in the volume chamber will remain lower. The flow rate will lower. The experiment was performed with an embodiment according to FIG. 4.

FIG. 5*b* shows the remaining contents in the receptacle [ml] and the spray of fluid from the orifice [g/sec] for a test receptacle of 260 ml filled with up to 130 ml water at a starting pressure of 11 bar. The table relates to two different second biasing means, e.g. two different gaskets 110 The first columns relate to a first spring e.g. a gasket 110 of a first material, whereas the second set relates to an embodiment with a different second biasing means, such as a spring or another gasket 110. Spring two is stronger. Spring two will further enlarge the size of the inlet. The reduction of the inlet is prevented by the second biasing means. The flow through the applicator will be larger. The column represent measurements at a linear time scale.

The pressures indicated at certain points in the columns indicate the pressure at that moment in the receptacle. The pressure in the receptacle has dropped from 11 bar to 4.5 and 5 bar respectively.

Although the present invention has been described in connection with preferred embodiments thereof, it will be appreciated by those skilled in the art that addition, modifications, substitutions and deletions not specifically described may be made without departing from the spirit and scope of the invention, limited only by the appending claims.

The invention claimed is:

1. Actuator for a dispenser device for spraying contents of a receptacle that is pressurized or of a receptacle that has a pump, the actuator comprising:

a channel connectable to a receptacle outlet (19) on one side (90) of the actuator for receiving the pressurized contents of the receptacle, said channel having an orifice (11) for spraying the pressurized contents on another side (91) of the actuator, wherein the channel comprises an expandable volume chamber (71) having a moveable wall, said orifice forming an outlet of the volume chamber, wherein the orifice has a valve for opening and closing the orifice, the valve biased by at least biasing means (27) in the closed position, which biasing means is also coupled with the moveable wall of the expandable volume chamber for biasing said wall in an unexpanded position of the chamber and further comprising actuation means arranged to allow a flow of the contents from the receptacle into the channel and expandable volume chamber, wherein the actuation means is coupled with the biasing means (27) for attenuating the bias on the valve biasing the valve in the closed position, if the actuation means is actuated, to allow the opening of the valve with a relative low force generated by the flow of contents to be sprayed.

2. Actuator according to claim 1, wherein the actuation means are coupled with the biasing means for releasing the bias on the valve.

3. Actuator according claim 1, wherein the biasing means comprise a leaf spring (27).

4. Actuator according to claim 1 wherein the actuator comprises opening means for opening the valve dependent on a pressure in the volume chamber.

5. Actuator according to claim 4, wherein the opening means comprise a pressure sensor element coupled with the valve for opening the valve upon reaching a threshold pressure in the volume chamber.

6. Actuator according to claim 5, wherein the pressure sensor element has a surface, and the surface forms a moveable wall of an expandable volume chamber.

7. Actuator according to claim 5, wherein the threshold pressure corresponds with a force to initiate movement of part of the openings means.

8. Actuator according to claim 1, wherein the actuator comprises a piston (40) having a piston body that is mounted moveable in the actuator, wherein the piston is received in the actuator.

9. Actuator according to claim 8, wherein the piston also forms the pressure sensor element.

10. Actuator according to claim 8, wherein the piston has a pin extending from the piston body forming the valve for closing the orifice.

11. Actuator according to claim 10, wherein the actuator comprises guiding means for guiding the pin onto the orifice.

12. Actuator according to claim 1, wherein a moveable piston forms a wall of the volume chamber, the valve (41) being integral with the piston.

13. Actuator according to claim 1, wherein the actuation means for allowing a flow of contents to enter the channel is coupled with the biasing means to attenuate the bias on the valve, and preferably an expandable volume chamber.

14. Actuator according to claim 1, wherein the actuator comprises inlet reduction means for reducing the size of an inlet to the volume chamber in an opened state of the orifice.

15. Actuator according to claim 14, wherein the pressure sensor element is coupled to the inlet reduction means for reducing the inlet size upon reaching a threshold pressure in the volume chamber.

16. Actuator according to claim 14, wherein the actuator comprises second biasing means for biasing the inlet reduction means against closing the inlet.

17. Actuator according to claim 16, wherein the second biasing means having an inactive state in the rest state of the actuator.

18. Actuator according to claim 16, wherein the second biasing means comprising a flexible sheet of material having an opening wherein the piston is received, an outer circumference the flexible sheet fixed in the actuator.

19. Actuator according to claim 14, wherein the inlet of the volume chamber is formed by a piston body and circular, interior wall of a housing part of the actuator and wherein an O-ring (42) is mounted on the piston and the O-ring forms the inlet reduction means adapted to reduce the size of the inlet of the volume chamber in the opened state.

20. Actuator according to claim 14, wherein the orifice cross sectional surface area is more than five time smaller than the volume chambers inlet cross sectional surface area in a working state of the actuator having a reduced inlet.

21. Actuator according to claim 14, wherein the reduced inlet of the volume chamber has a width of less than 0.1 mm.

22. Actuator according to claim 1, wherein the actuator comprises at least an actuator hood (1), a first part (10) receivable in the actuator hood having the orifice and the channel's inlet, a second part (30) receivable in the first part for forming the channel from the inlet to the orifice and the piston receivable in the second part.

23. Actuator according to claim 1, wherein the actuator comprises at least an actuator hood (1), a first part (10) receivable in the actuator hood having the orifice and the channel's inlet, a second part (30) receivable in the first part for forming the channel from the inlet to the orifice, the piston receivable in the second part, and a third part received in the second part for locking a spring (50) that engages on the piston body biasing the piston for closing the orifice.

24. Pressurized receptacle and actuator assembly comprising an actuator according to claim 1.

25. Method for spraying contents of a receptacle comprising:

providing a receptacle (20) having contents that is pressurized or a receptacle having a pump, biasing a valve for opening and closing an orifice (11) for spraying the contents in a position closing the orifice, the valve being biased by at least one biasing means, which biasing means is also coupled with a moveable wall of an expandable volume chamber for biasing said wall in an unexpanded position of the volume chamber, upon actuation, spraying the contents out of the orifice, the orifice forming an outlet of the expandable volume chamber that is connected to the receptacle via an inlet, the contents flowing through the inlet, volume chamber and orifice, wherein the method further comprises attenuating the bias on the valve closing the orifice upon actuation to allow the opening of the valve with a relative low force generated by the flow of contents to be sprayed.

26. Method according to claim 25, wherein the method further comprises upon actuation building up a pressure by the flow of contents into the volume chamber and subsequently expanding the volume chamber by moving a piston.

27. Method according to claim 25, wherein expanding the volume chamber and opening the orifice is directly- coupled.

28. Method according to claim 25, wherein expanding the chamber is coupled with reducing the size of the inlet.

* * * * *